US011912491B2

(12) United States Patent
Erwin et al.

(10) Patent No.: US 11,912,491 B2
(45) Date of Patent: Feb. 27, 2024

(54) SPRAYER ASSEMBLY

(71) Applicant: BG Intellectuals, Inc., Wichita, KS (US)

(72) Inventors: Michael Jason Erwin, Augusta, KS (US); Bradley Robert Young, Wichita, KS (US); Stephen Marvin Pederson, Wichita, KS (US); Zachary Adam Dold, Colwich, KS (US)

(73) Assignee: BG Intellectuals, Inc., Wichita, KS (US)

( * ) Notice: Subject to any disclaimer, the term of this patent is extended or adjusted under 35 U.S.C. 154(b) by 0 days.

(21) Appl. No.: 17/983,803

(22) Filed: Nov. 9, 2022

(65) Prior Publication Data

US 2023/0146584 A1 May 11, 2023

Related U.S. Application Data

(60) Provisional application No. 63/339,271, filed on May 6, 2022, provisional application No. 63/277,504, filed on Nov. 9, 2021.

(51) Int. Cl.
*B65D 83/20* (2006.01)
*B65D 83/42* (2006.01)

(52) U.S. Cl.
CPC ..... *B65D 83/42* (2013.01); *B65D 83/202* (2013.01)

(58) Field of Classification Search
CPC ..... B05B 3/00; B05B 7/1209; B05B 7/2437; B05B 7/2478; B05B 9/0805;
(Continued)

(56) References Cited

U.S. PATENT DOCUMENTS 1,919,153 A 7/1933 Andrews
1,957,686 A 5/1934 Andrews
(Continued)

FOREIGN PATENT DOCUMENTS

DE 202007003070 U1 7/2008
DE 202009011168 U1 2/2010
(Continued)

OTHER PUBLICATIONS

Amazon, "Critter Spray Products 22032 118SG Siphon Gun"; https://www.amazon.com/Critter-Spray-Products-22032-Siphon/dp/B00006FRPJ?th=1.
(Continued)

*Primary Examiner* — David P Angwin
*Assistant Examiner* — Randall A Gruby
(74) *Attorney, Agent, or Firm* — Shook, Hardy & Bacon L.L.P.

(57) ABSTRACT

This application describes a sprayer assembly that can attach to a variety of different types of pre-filled, fluid containers (e.g., non-pressurized fluid containers) for holding the fluid to be sprayed. For example, the sprayer assembly can include a sprayer-head assembly for attaching to a container of fluid, a canister for holding the container of fluid, or any combination thereof In addition, the sprayer assembly can be connected to a variety of different types of pressurized air sources. The sprayer-head assembly can include a nozzle assembly (e.g., fluid uptake tube, valve, and nozzle head), as well as a trigger for actuating the nozzle assembly.

10 Claims, 7 Drawing Sheets

(58) Field of Classification Search
CPC .. B05B 12/002; B65D 83/201; B65D 83/202; B65D 83/384; B65D 83/40; B65D 83/42
See application file for complete search history.

(56) References Cited

U.S. PATENT DOCUMENTS

| | | | | | |
|---|---|---|---|---|---|
| 2,888,207 | A | | 5/1959 | Sykes | |
| 3,066,838 | A | * | 12/1962 | Lloyd | B65D 83/201 222/402.15 |
| 3,119,528 | A | | 1/1964 | Dunning | |
| 3,506,159 | A | * | 4/1970 | Arthur | B65D 83/202 222/323 |
| 3,659,791 | A | * | 5/1972 | Clark | B65D 83/202 239/375 |
| 3,734,357 | A | * | 5/1973 | Batistelli | B65D 83/202 222/323 |
| 3,815,819 | A | * | 6/1974 | Hamlin | B65D 83/68 118/301 |
| 4,579,258 | A | * | 4/1986 | Brown | B65D 83/202 222/323 |
| D287,394 | S | * | 12/1986 | Yamamoto | D23/225 |
| 4,805,812 | A | * | 2/1989 | Brody | B65D 83/202 222/402.15 |
| 4,971,257 | A | * | 11/1990 | Birge | B65D 83/384 222/402.15 |
| 5,904,273 | A | * | 5/1999 | Aspacher | B65D 83/202 222/402.15 |
| 6,003,787 | A | | 12/1999 | Fisher | |
| 6,883,732 | B2 | | 4/2005 | Hasegawa | |
| 6,896,192 | B2 | * | 5/2005 | Horan | G01B 11/026 239/289 |
| 6,953,155 | B2 | | 10/2005 | Joseph et al. | |
| 7,246,728 | B2 | | 7/2007 | Nottingham et al. | |
| 7,661,604 | B1 | | 2/2010 | Maclean-Blevins | |
| 8,052,015 | B2 | * | 11/2011 | Huang | B65D 83/202 222/323 |
| 8,272,542 | B2 | * | 9/2012 | Becker | B65D 83/202 222/323 |
| 10,562,078 | B2 | | 2/2020 | Dehn | |
| 11,020,759 | B2 | | 6/2021 | Bierie | |
| 11,065,636 | B2 | | 7/2021 | Fideler et al. | |
| 2012/0080455 | A1 | * | 4/2012 | Jug | B65D 83/202 222/402.15 |
| 2016/0059252 | A1 | | 3/2016 | Krayer et al. | |
| 2017/0043361 | A1 | | 2/2017 | Smuin | |
| 2018/0111146 | A1 | | 4/2018 | Strong | |

FOREIGN PATENT DOCUMENTS

| | | | |
|---|---|---|---|
| DE | 102017004986 | A1 | 11/2018 |
| EP | 1088602 | A1 | 4/2001 |
| GB | 332676 | A | 7/1930 |
| KR | 20200001933 | A | 1/2020 |
| KR | 102338161 | B1 | 12/2021 |

OTHER PUBLICATIONS

Etsy, "Vintage Electrolux Spray Paint Sprayer Glass Jar , Octagonal"; https://www.etsy.com/listing/964025965/vintage-electrolux-spray-paint-sprayer.

Home Depot, "Paint Zoom Deluxe 3000 Series 30 oz. Paint Containers, Handheld HVLP Paint Sprayer, 700 watt Spray Gun Tool, 3 Spray Patters"; https://www.homedepot.com/p/Paint-Zoom-Deluxe-3000-Series-30-oz-Paint-Containers-Handheld-HVLP-Paint-Sprayer-700-watt-Spray-Gun-Tool-3-Spray-Patters-90PZ02BM01/317673093.

Lazada, "High Pressure Paint Air Spray Gun Set 1.5MM Nozzle 1000CC Capacity—4001"; https://www.lazada.com.my/products/high-pressure-paint-air-spray-gun-set-15mm-nozzle-1000cc-capacity-4001-1187772801.html.

* cited by examiner

SPRAYER ASSEMBLY

CROSS REFERENCE

This application claims the benefit of U.S. Provisional Application No. 63/277,504 (filed on Nov. 9, 2021) and U.S. Provisional Application No. 63/339,271 (filed May 6, 2022), each of which is incorporated herein by reference in its entirety.

BACKGROUND

Fluids applied in an aerosolized form are a vital component in many industries, such as painting, automotive servicing, liquid-application fertilizer, pest control, and the like. Some conventional solutions as include storing fluids in pre-pressurized cans. This can suffer from various disadvantages, such as storage logistics, non-usability based on damage to the can or nozzle, limited recyclability, and the like.

DETAILED DESCRIPTION OF DRAWINGS

The present systems and methods for a sprayer assembly are described in detail below with reference to these figures.

DETAILED DESCRIPTION

Figure 1:
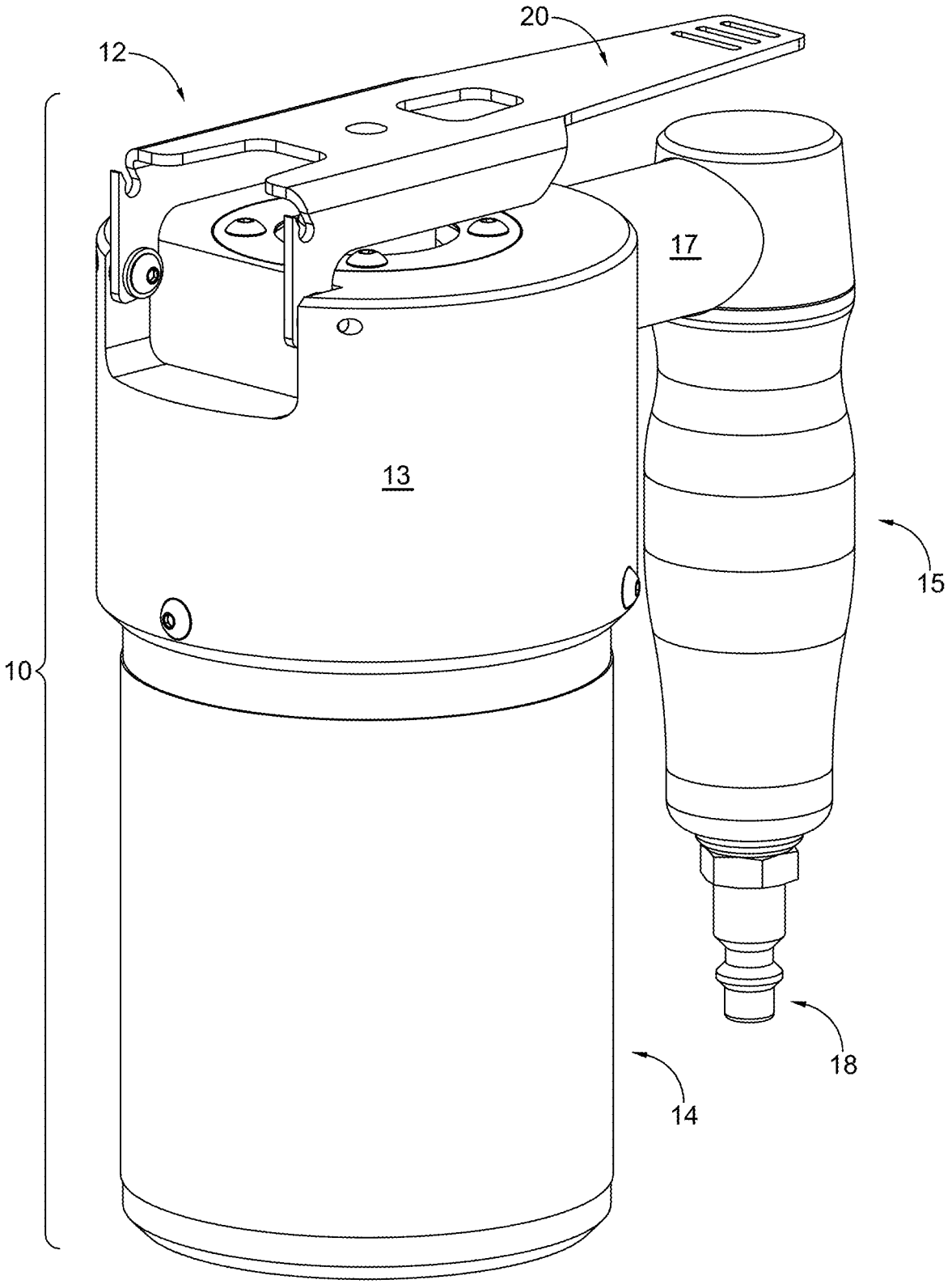
FIG. 1 depicts a sprayer assembly, in accordance with examples of this disclosure.

This detailed description is related to a sprayer assembly that can be connected to a variety of different types of pressurized air sources for spraying a fluid. In addition, the sprayer assembly is configured to work with a variety of different types of pre-filled, fluid containers for holding the fluid to be sprayed. For example, the sprayer assembly can include a sprayer-head assembly that removably and sealingly connects to a canister. In at least some examples, the fluid container can be positioned inside the canister and the sprayer-head assembly can be sealingly connected to the canister (e.g., with the fluid container enclosed within). In addition, the sprayer-head assembly can be connected to various types of pressurized air sources (e.g., shop air in an automotive servicing facility or an air compressor), such that when a trigger of the sprayer-head assembly is actuated (e.g., pressed), the sprayer-head assembly can dispense the fluid from the container (e.g., spray the fluid in an aerosolized form).

In contrast to the present disclosure, some conventional solutions can include storing fluid in pressurized canisters (e.g., pressurized aerosol cans that do not rely on an external source of pressurized air). However, pressurized canisters can require additional initial processing (e.g., to pressurize and seal the canister) and can be require various storage logistics (e.g., to protect the canisters). In addition, damage to the pressurized canisters can render the produce unusable and/or can cause damage to surrounding people and products. Furthermore, pressurized canisters can be challenging to recycle, based on challenges associated with cleaning out the fluid, the combination of various types of materials, and the like. However, examples associated with the present disclosure allow for fluid containers to be stored in a non-pressurized state and simply placed into the canister associated with the subject sprayer assembly. In addition, after use, the fluid container can be easily rinsed and reused or recycled, while the sprayer assembly can be reused with subsequent fluid containers.

In at least some examples, the sprayer assembly can be used in various contexts and industries that are related to dispersing various types of chemicals or solutions, such as paints, cleaning solutions, fertilizer, pesticide, etc. In an automotive servicing context, the tool can be used to apply an aerosolized liquid to various vehicle components (e.g., brakes, engine components, fluid lines, etc.).

In some examples, the sprayer assembly includes the sprayer-head assembly and the canister. In addition, a pre-filled, non-pressurized fluid container can be placed into the canister (e.g., through a top opening), and the sprayer-head assembly can then be attached to the top of the canister. The sprayer-head assembly can be affixed to, or removed from, the top of the canister in various manners. For instance, the sprayer-head assembly can threadably attach or screw onto the top of the canister. In one example, internal pegs inside the top of the sprayer-head assembly can mate into an external groove or channel on the outside of the canister to help in locking and sealing the sprayer-head assembly to the canister. In some examples, the channel can have two (or more) resting positions: engaged and neutral. The neutral area can be a safety feature that keeps the canister connected to the top but does not allow it to seal or charge. The engagement area is indicated by an audible "click" so the user knows that tool can now be used properly. The channel design can impede canister removal until pressure has been released.

As indicted, with the sprayer-head assembly removed, the fluid container can be placed into the canister. In examples, a bottom of the canister can include a biasing feature that biases the fluid container "upward" or towards the top opening of the canister. As such, when the sprayer-head assembly is attached to the canister, the fluid container can be pressed into a sealing member of the sprayer-head assembly. For example, the biasing feature can include a convex surface that engages a bottom of the fluid container. As such, a rim (or other top edge) of the fluid container can be pressed into the sprayer-head assembly to reduce the likelihood of over-spilling (e.g., when the system is pressurized).

In examples, the sprayer-head assembly can include a fitting for attaching to an air source (e.g., a quick release fitting for connecting to an air hose). The fitting can connect, in the sprayer-head assembly, to a fluid channel that carries pressurized air to the canister and/or the fluid container enclosed in the canister. For example, the sprayer-head assembly can include a handle, which can include the fitting, such that the channel travels through the handle to the canister and/or fluid container. Furthermore, in at least some examples, the channel can be associated with a pressure regulator (e.g., internal within the sprayer-head assembly), which can control the allowable pressure level of the contents to ensure that the device operates the same even with a variety of input pressures. In some instances, the regulator can be adjusted prior to assembly to meet the requirements of the type of fluid that a tool will be used for.

In at least some examples, the sprayer-head assembly can include a check valve that can maintain the pressure in the system, even after the air source has been disconnected (e.g., if the fitting is disconnected from the air hose). As such, the sprayer assembly can be pressurized, disconnected from the pressurized air source, and then remotely used to disperse the fluid. Furthermore, the sprayer-head assembly can include a pressure relief valve that allows the sprayer assembly to be depressurized (e.g., for storage or after use).

In some examples, the sprayer-head assembly is configured to be used with a standard aerosol valve assembly (e.g., 1" valve assembly). That is, the sprayer-head assembly can include an aerosol valve compartment that is accessible by a removable flange. The removable flange can be removed (e.g., by removing fastener hardware such as a series of bolts) to access the aerosol valve compartment, such as to insert or replace a valve assembly. As such, examples of the present disclosure allow for the sprayer assembly to be easily maintained by simply removing a used aerosol valve assembly (e.g., where the used valve assembly might be worn, clogged, damaged, etc.) and replacing it with a new aerosol valve assembly. Furthermore, the universality of the sprayer assembly with respect to various valve assemblies allows for the valve assembly to be changed based on the fluid to be dispersed.

In at least some examples, the sprayer-head assembly can include a trigger lever that engages the actuator cap of the aerosol valve assembly. For example, the trigger lever can include a size that allows for the trigger lever to be easily operated while the operator grips the handle.

The sprayer assembly can include various features. For example, the sprayer assembly can be implemented with off-the-shelf, pre-filled, non-pressurized fluid containers. As such, an operator might not need to handle or pour any fluids which reduces potential hazards from contact and spills. The lack of propellants in the packaging can also allow the fluid to sit on shelves longer and transport better.

In some examples, the industrial air coupling, integrated check valve, and regulator allows the device to spray product both while connected to a pressurized air hose or disconnected using the built-up internal air pressure. The regulator can be adjusted to vary the output performance of the fluid in relation to the type of actuator used.

Various examples are described below with reference to the drawings, and the relationship and functioning of the various elements of the examples can better be understood by reference to the following detailed description. However, examples associated with the present invention are not limited to those illustrated in the drawings or explicitly described below. It also should be understood that the drawings are not necessarily to scale, and in certain instances details may have been omitted that are not necessary for an understanding of examples disclosed herein, such as conventional assembly.

FIG. 1 illustrates a sprayer assembly 10 that can be connected to a variety of different types of pressurized air sources and that is configured for spraying a fluid. In addition, the sprayer assembly is configured to work with a variety of different types of pre-filled, fluid containers for holding the fluid to be sprayed. For example, the sprayer assembly can include a sprayer-head assembly 12 that removably and sealingly connects to a canister 14. At a high level, the sprayer-head assembly 12 includes a lid 13, a handle 15, and a stem 17, which connects the handle 15 to the lid 13. In at least some examples, the canister 14 at least partially encloses a volume (e.g., the volume 51 in FIG. 3); the fluid container can be positioned inside the canister 14 (e.g., within the volume); and the sprayer-head assembly 12 (e.g., the lid 13 of the sprayer-head assembly 12) can be sealingly connected to the canister 14 (e.g., with the fluid container enclosed within).

Figure 2:
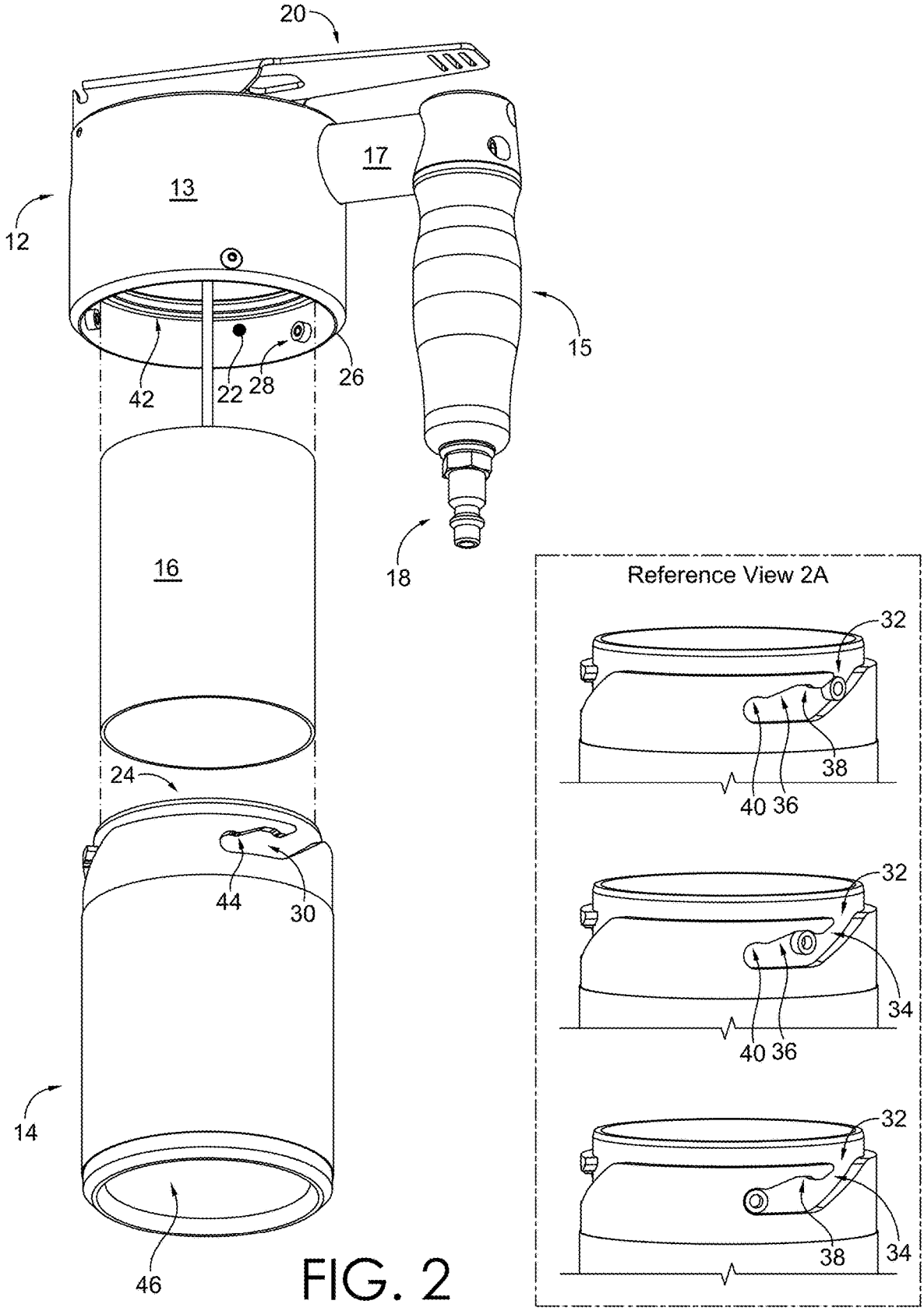
FIG. 2 depicts the sprayer assembly of FIG. 1 with a sprayer-head assembly decoupled from a canister and a container positioned to be placed in the canister, based on examples of this disclosure.

For example, referring to FIG. 2, the sprayer-head assembly 12 is decoupled from the canister 14, and a fluid container 16 is depicted that could be placed inside the canister 14. The fluid container 16 is an example, and a variety of different fluid containers could be used with the sprayer assembly 10 (e.g., fluid containers of various sizes and shapes). In at least some examples, the sprayer-head assembly 10 includes a coupling or fitting 18 (e.g., push-style, quick connect, air-hose coupling) for connecting to a pressurized air source (e.g., shop air in an automotive servicing facility or an air compressor). In examples, the pressurized air can pressurize the sprayer assembly 10 (e.g., the container 16, the canister 14, etc.), such that when a trigger 20 of the sprayer-head assembly 12 is actuated (e.g., pressed), the sprayer-head assembly 12 can dispense the fluid from the container 16 (e.g., spray the fluid in an aerosolized form).

The sprayer assembly 10 an include various other elements. For instance, the sprayer-head assembly 12 can be affixed to, or removed from, the canister 14 in various manners. In some examples, the sprayer-head assembly 12 can threadably attach or screw onto the top of the canister 14. For example, the sprayer-head assembly 12 and the canister 14 can include threads (e.g., external and internal) that mate to connect the parts. In at least one example, the sprayer-head assembly can include the lid 13 associated with a cavity 22 configured to receive at least a portion of an upper rim 24 of the canister 14, and the cavity 22 can include a peripheral wall 26 enclosing the sides of the cavity 22. In addition, the peripheral wall 26 can include an internal protuberance 28 (e.g., peg or post) that projects inwardly from the peripheral wall 26 and into the cavity 22. In at least some examples, the internal protuberance 28 is configured to mate with a corresponding element associated with the canister 14. For example, the canister 14 can include an external channel 30 (e.g., channel in the outward oriented face of the canister 14) that is configured to receive the internal protuberance 28 when the upper rim 24 of the canister 14 is engaged with the cavity 22. The sprayer assembly 10 can include one or more sets of mating protuberances and channels. For instance, in accordance with one example, the figures depict three sets of protuberances and channels that can mate with one another. The sprayer assembly 10 can, in some examples, include few than, or more than, three sets. In the sprayer assembly 10, the protuberance 28 can mate with the canister 14, and in some examples, the protuberance 28 can mate with a groove or channel on a container of fluid (e.g., a coupling mechanism that projects inwardly towards the cavity and is configured to selectively engage the container of fluid, the canister for holding the container of fluid, or any combination thereof.)

The channel 30 can include various elements configured to engage with the internal protuberance 28 at different positions as the internal protuberance 28 is traversed along the channel 20 (e.g., as the sprayer-head assembly 12 and the canister 14 are rotated relative to on another with the mount 24 engaged within the cavity 22). In addition, to help illustrate there various elements, reference view 2A is provided showing the internal protuberance 28 at different positions with respect to the channel 30. For example, the channel 30 can include a mouth 32 or opening configured (e.g., having a width or size) to receive the internal protuberance 28, and the mouth 32 can transition to one or more ramp interfaces 34 and 36. That is, as the internal protuberance 28 enters the channel 30 through the mouth 32 and continues along the channel 30 (e.g., when the parts are rotated), the ramp interfaces 34 and 36 can pull the canister 14 further into the cavity 22 of the sprayer-head assembly 12 to a position. In at least some examples, the ramp interfaces 34 and 36 can transition to one or more channel recesses 36 and 38 configured to retain the internal protuberance 28 in association with a position. For example, as the sprayer-head assembly 12 is rotated relative to the canister 14 (e.g., clockwise in FIG. 2A), the first ramp interface 34 can urge or bias the internal protuberance 28 (e.g., similar to a camming relationship) into the first channel recess 38, and when rotated further, the second ramp interface 36 can urge or bias the internal protuberance into the second channel recess 40. In at least some examples, the relatively short travel associated with the channel 30 (e.g., as opposed to a channel that has a longer length and extends to a further extent around the canister 14) contributes to easier and faster opening and closing of the sprayer assembly 10.

In at least some examples, the first channel recess 38 and the second channel recess 40 can be associated with different relative degrees of connection or seal between the sprayer-head assembly 12 and the canister 14. For example, when the internal protuberance 28 is retained in the first channel recess 38, the canister 14 can be coupled to the sprayer-head assembly (e.g., in the sense that the canister 14 could freely hang from the sprayer-head assembly 12, while remaining connected to the sprayer-head assembly), but the sprayer assembly 10 might not be configured to contain pressurized air if introduced into the system. In some example, the first channel recess 38 can be associated with a neutral or safety feature, which can keep the canister 14 connected to the sprayer-head assembly, but does not allow the sprayer assembly 10 to seal or charge. When the internal protuberance 28 is retained in the second channel recess 40, the upper rim 24 of the canister 14 can be pulled into a more tightly sealed connection within the cavity 22. For example, an annular seal 42 within the cavity 22 can seal against the upper rim 24 of the canister 14 and/or the cavity 22 can include a O-ring, gasket, or other component for sealing against the upper rim 24. In some examples, based at least partially on the shape of the second channel recess 40 (e.g., a small edge 44 that extends into the channel 30), the internal protuberance 28 can audibly "click" when rotated into an engaged position within the second channel recess 40, and the audible click can notify the user when the sprayer assembly 10 is sealed and configured to be charged. In at least some examples, the edge 44 can also impede disengagement between the canister 14 and the sprayer-head assembly 12, until pressure within the system has been released.

As indicted, with the sprayer-head assembly 12 removed, the fluid container 16 can be placed into the canister 14. In examples, and referring to FIG. 2 and FIG. 3, a bottom 46 of the canister 14 can include a biasing feature 48 that biases the fluid container 16 "upward" or into the sprayer-head assembly 12. For example, the biasing feature 48 can include a raised surface that projects or curves towards into the cavity of the canister 14. As such, when the sprayer-head assembly 12 is attached to the canister 14, the fluid container 16 (e.g., an upper rim 19 of the fluid container 16) can be pressed into an annular shoulder 50 (e.g., annular surface, rim, gasket, etc.) of the sprayer-head assembly 12. In at least some examples, the biasing feature 48 can be elastic (e.g., such as made from a rubber or elastic material), such that the biasing feature 48 can compress to accommodate containers of various heights, while still pressing the container 16 upwards and into the lid 13. Among other things, the interfacing of the fluid container 16 with the annular shoulder 50 can reduce the likelihood of fluid from the fluid container 16 spilling over into the canister 14 and can reduce movement of the fluid container 16 when contained within the sprayer assembly 10. In some examples, the upper rim 19 of the fluid container 16 can contact the annular shoulder 50. In some examples, the upper rim 19 can be adjacent and directly below the annular shoulder 50, but not directly abutting, such that a small gap is present between the upper rim 19 and the annular shoulder 50. In at least some examples, the annular shoulder 50 can include a notch 52 that allows fluid communication to between various compartments within the system (e.g., which might otherwise be sealed off if the surface 50 annularly extended entirely around the cavity 22 and in contact with the upper rim of the fluid container 16). For example, via the notch 52, the cavity 22 of the lid 13 can be in fluid communication with the volume 51 of the canister 14.

In examples, the sprayer-head assembly 12 can include a fitting 18 for attaching to an air source (e.g., a quick release fitting for push connecting to an air hose). The fitting 18 or coupling can connect to a fluid channel 54 or fluid conduit that carries pressurized air to various parts of the sprayer assembly 10. For example, the fitting 18 can be couple to a portion of the handle 15 (e.g., the end of the handle 15), and the fluid channel 54 can extend through the handle 56 and towards the cavity 22. In at least one example, the sprayer-head assembly 12 can include the stem 17 that connects the handle 15 to the lid 13, and the fluid channel 54 can extend through the stem 17. In at least some examples, the sprayer-head assembly 12 can include various other components within the fluid channel 54 (e.g., within the path of the pressurized air as it passes from the fitting 18 to the cavity 22). For instance, in at least some examples, the channel 54 can be associated with a pressure regulator 58 (e.g., internal within the stem 17 or within another part of the sprayer-head assembly 12), which can control the allowable pressure level of the contents to ensure that the device operates the same even with a variety of input pressures. In some instances, the regulator 58 can be adjusted prior to assembly to meet the requirements of the type of fluid that a tool will be used for. In at least some examples, the sprayer-head assembly 12 can include a check valve 60 that can maintain the pressure in the sprayer assembly 10, even after the air source has been disconnected (e.g., if the fitting is disconnected from the air hose). For example, the check valve 60 can be positioned in the channel 54 and after the pressure regulator 58. In some examples, the check valve can be positioned in other parts of the assembly and/or before the pressure regulator 58. As such, the sprayer assembly can be pressurized, disconnected from the pressurized air source, and then remotely used to disperse the fluid. Furthermore, the sprayer-head assembly can include a pressure relief valve that allows the sprayer assembly to be depressurized (e.g., for storage or after use).

Figure 3:
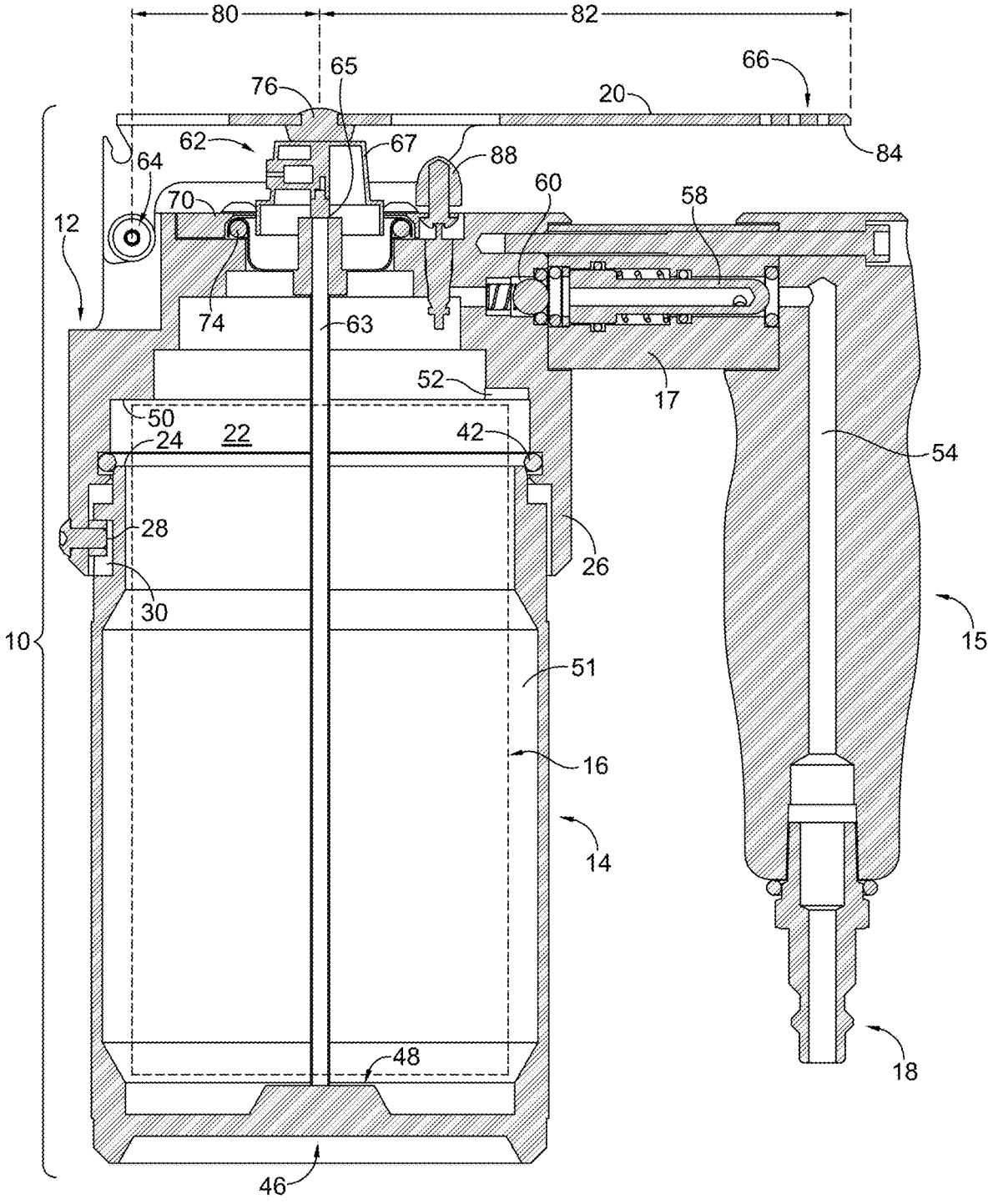
FIG. 3 depicts a cross-sectional view of the spray assembly, in accordance with an example of this disclosure.
Figure 4:
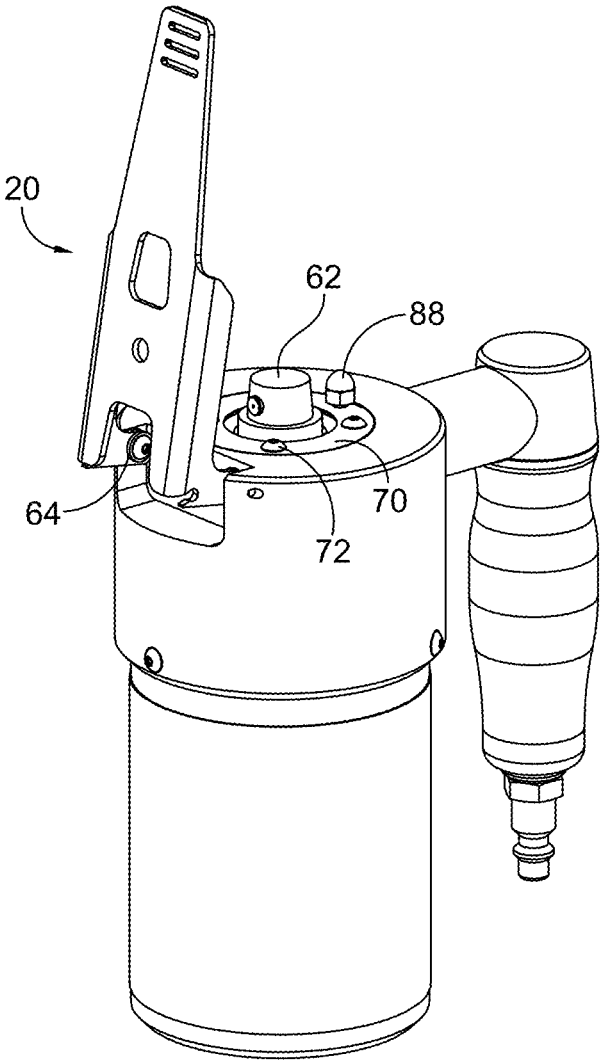
FIG. 4 depicts the sprayer assembly with a trigger rotated to an upward position to show a nozzle assembly, in accordance with an example of this disclosure.
Figure 5:
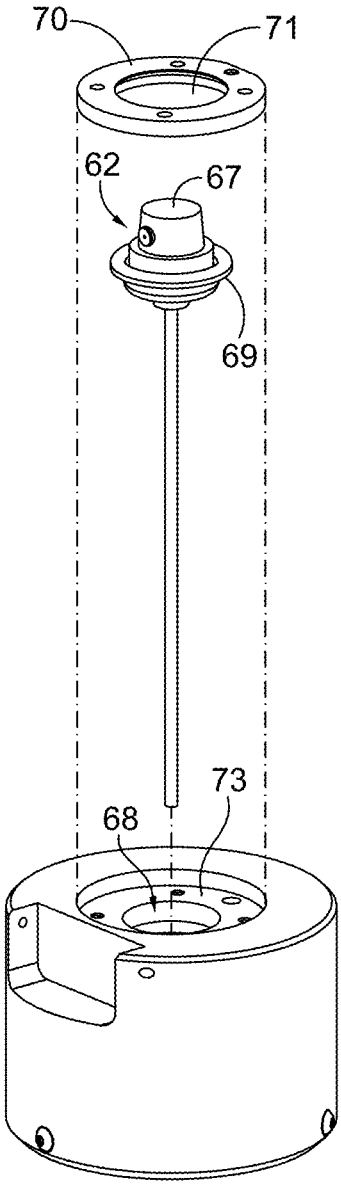
FIG. 5 depicts a nozzle assembly, in accordance with an example of this disclosure.
Figure 6:
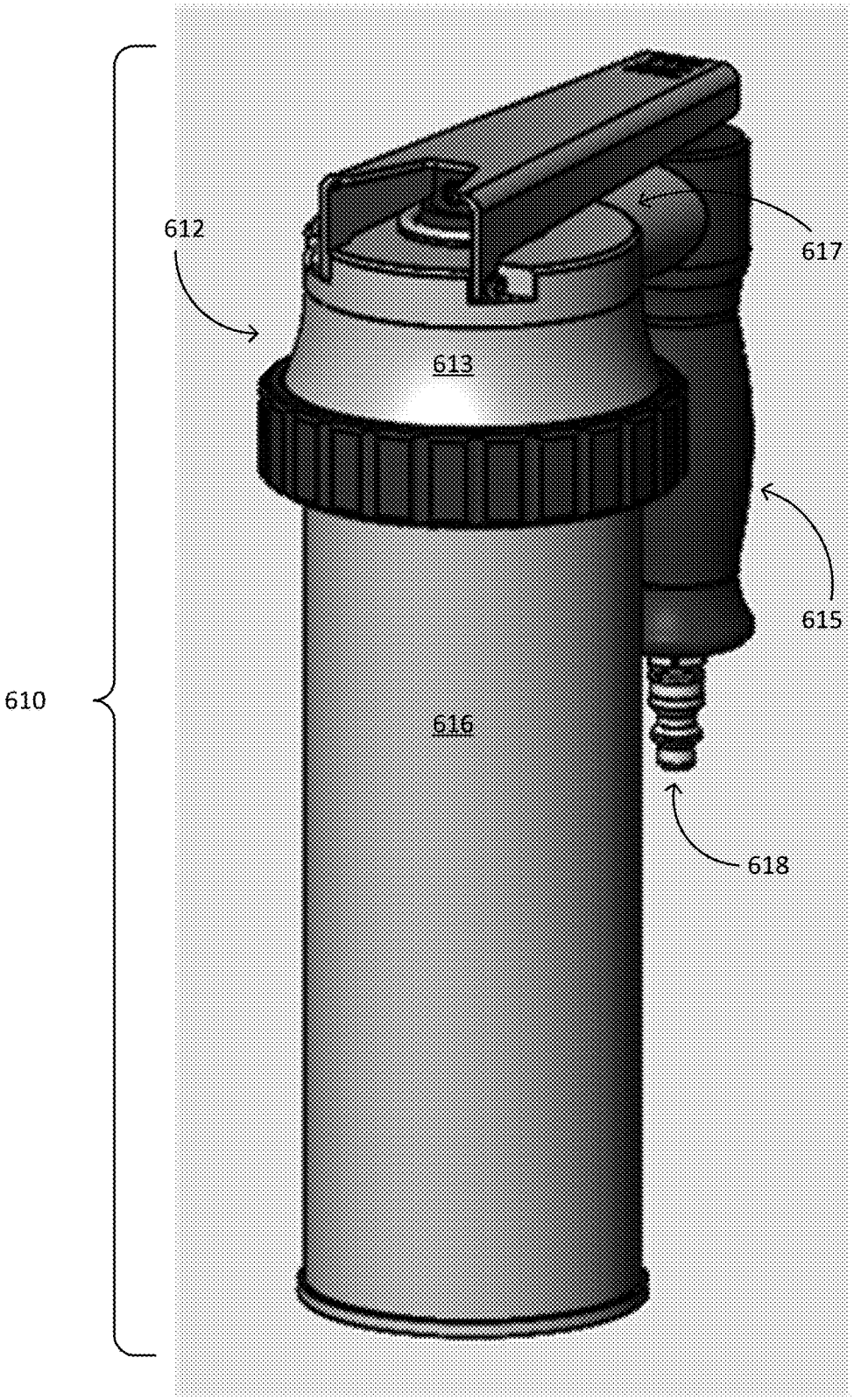
FIG. 6 depicts another sprayer assembly with a different fluid container, in accordance with an example of this disclosure.
Figure 7:
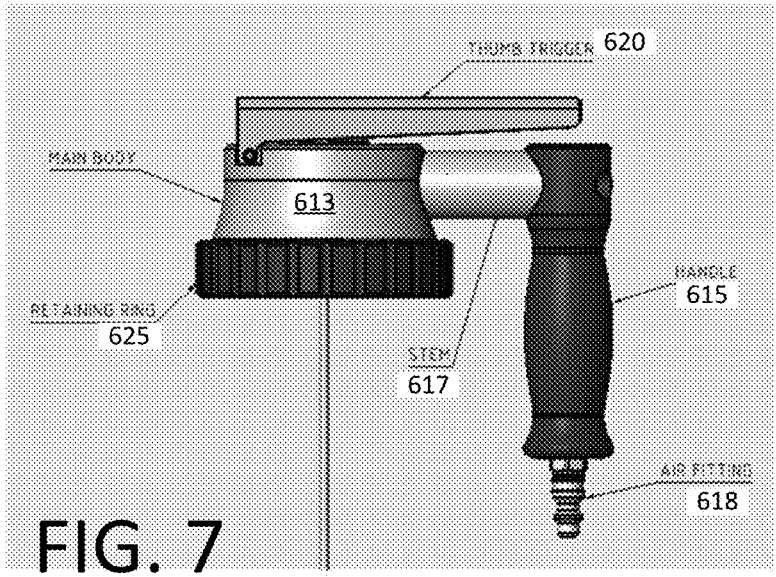
FIG. 7 depicts a sprayer-head assembly of the sprayer assembly in FIG. 6, in accordance with an example of this disclosure.

Referring to FIG. 3, FIG. 4, and FIG. 5, the sprayer-head assembly 12 can include an aerosol valve assembly 62, which is actuatable via the trigger 20. That is, the trigger 20 can be pivotably or hingedly or rotatably connected to the sprayer-head assembly 12 at the connection 64, such that when the end 66 of the trigger 20 is depressed, the aerosol valve assembly 62 is actuated. In this sense, the trigger 20 operates as a lever where the connection 64 is a fulcrum. In addition, the trigger 20 can be rotated to an up position (e.g., FIG. 4) to allow access to the aerosol valve assembly 62.

In some examples, the sprayer-head assembly 12 is configured to be used with an aerosol valve assembly 62 (e.g., 1" valve assembly), which can include a fluid update tube 63, a nozzle valve 65 (e.g. FIG. 3), and a nozzle head 67 (e.g., aerosol cap that when depressed can disperse fluid). In addition, the valve assembly 62 can include an annular flange 69 that extends around the nozzle valve 65 and/or nozzle head 67. In examples, the sprayer-head assembly 12 can include an aerosol valve compartment 68 that is accessible by a removing a cover 70 (e.g., by removing the fasteners 72), which can include an opening 71 or through hole for receiving the nozzle head 67. In examples, the cover 70 can be removed (e.g., by removing fastener hardware such as a series of bolts) to access the aerosol valve compartment 68, such as to insert or replace a valve assembly 62. In at least some instances, the valve compartment 68 can include an annular shelf 73 that can support the annular flange 69 of the valve assembly 62. In addition, when the nozzle assembly 62 is installed, an O-ring 74 (e.g., FIG. 3) or other sealing member can be positioned between the annular flange 69 and the annular shelf 73, such that a seal is maintained when the cover 70 is tightened into position. That is, when the cover 70 is installed atop the annular flange 69, the annular flange 69 can be secured in position between the cover 70 and the annular shelf 73. As such, examples of the present disclosure allow for the sprayer assembly to be easily maintained by simply removing a used aerosol valve assembly (e.g., where the used valve assembly might be worn, clogged, damaged, etc.) and replacing it with a new aerosol valve assembly. Furthermore, the universality of the sprayer assembly with respect to various valve assemblies allows for the valve assembly to be changed based on the fluid to be dispersed. In examples, various standard valve assemblies can be used with the sprayer assembly 10.

The trigger 20 can include various features. For example, as explained, the trigger 20, when pressed downward can actuate the aerosol valve assembly 62. That is, the trigger 20 can include a rubber pad 76 (or similar element) that engages nozzle head 67 of the aerosol valve assembly 62. In some examples, the trigger 20 can include a size (e.g., length) that allows for the trigger 20 to operate as a lever, which can be easily operated while the operator grips the handle 15. For example, a distance 80 between the connection 64 and the middle of the nozzle head 65 can be shorter than a distance 82 from the center of the nozzle head 65 to a distal end 84 of the trigger 20. In some examples, the distance 82 can be twice the distance 80. The trigger 20 can include other elements as well. For example, the trigger 20 can include a can opener 86, which can allow for easy opening of prefilled fluid containers, such as the fluid container 16.

In examples, the sprayer assembly 10 can include other elements as well. For example, a pressure relief valve 88 can be arranged in one or more various locations, and in one example, at least a part of the pressure relief valve 88 extends through the flange 70 and is in communication with the cavity 22. As such, by opening or closing the valve 88 (e.g., by rotating) pressure can be maintained/sealed or released from the cavity 22.

The sprayer assembly 10 can be constructed of various materials, and in some examples, the canister 14 and at least some parts of the sprayer-head assembly 12 are metal (e.g., aluminum). As such, the sprayer assembly 10 can be robust and withstand harsh environments, drops, etc.

Examples associated with the present disclosure allow for fluid containers to be stored in a non-pressurized state and simply placed into the canister associated with the subject sprayer assembly. In addition, after use, the fluid container can be easily rinsed and reused or recycled, while the sprayer assembly can be reused with subsequent fluid containers. In at least some examples, the sprayer assembly can be used in various contexts and industries that are related to dispersing various types of chemicals or solutions, such as paints, cleaning solutions, fertilizer, pesticide, etc. In an automotive servicing context, the tool can be used to apply an aerosolized liquid to various vehicle components (e.g., brakes, engine components, fluid lines, etc.).

In some examples, referring to FIGS. 6 to 9, a sprayer assembly 610 can include alternative features, which could be used with other types of fluid containers. For example, the sprayer assembly 610 can include a sprayer-head assembly 612 that connects directly to a container 616. As such, the sprayer assembly 610 can provide a repeat-use sprayer that can be used with pre-filled fluid containers that do not need to be pressurized. In examples, the sprayer assembly 610 may not need a separate canister (e.g., such as the canister 14), and the sprayer-head assembly can connect directly to the fluid container 616.

Figure 8:
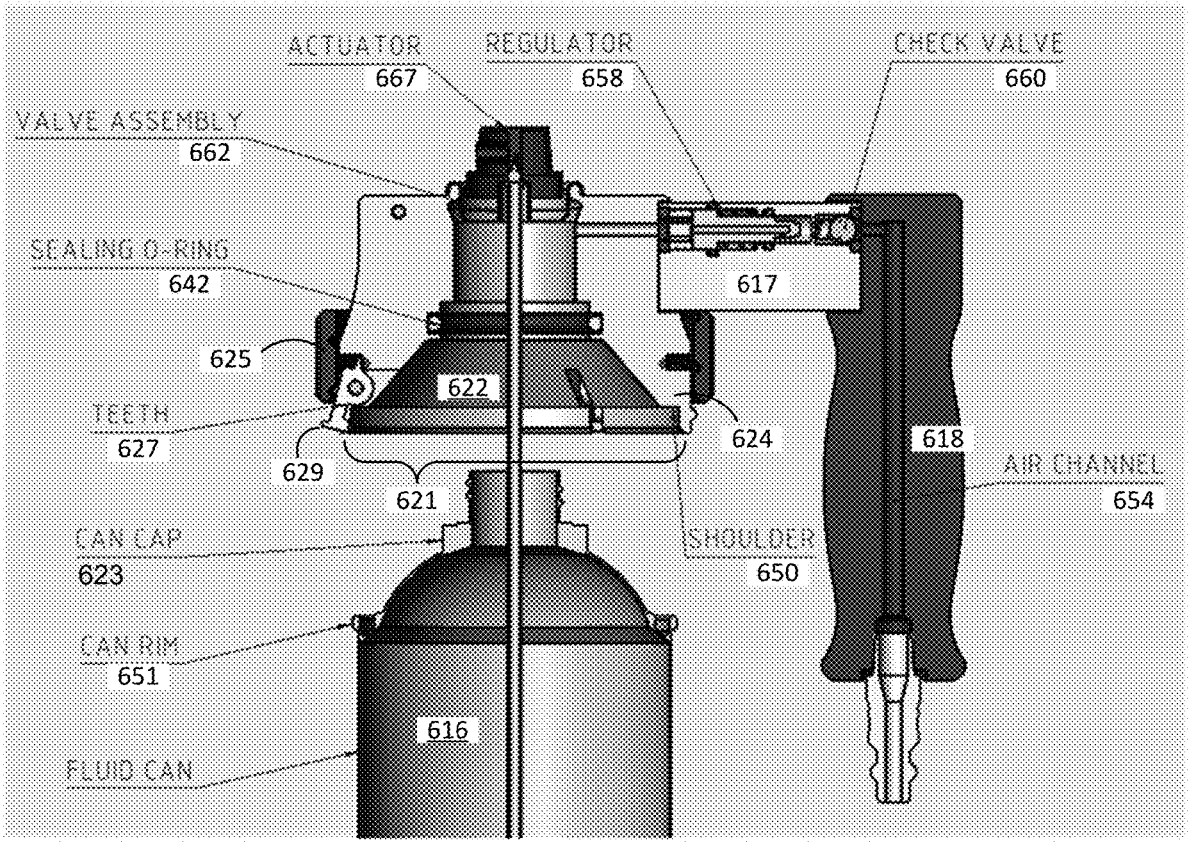
FIGS. 8 and 9 depict cross-sectional views associated with the sprayer-head assembly of FIG. 7, in accordance with an example of this disclosure.
Figure 9:
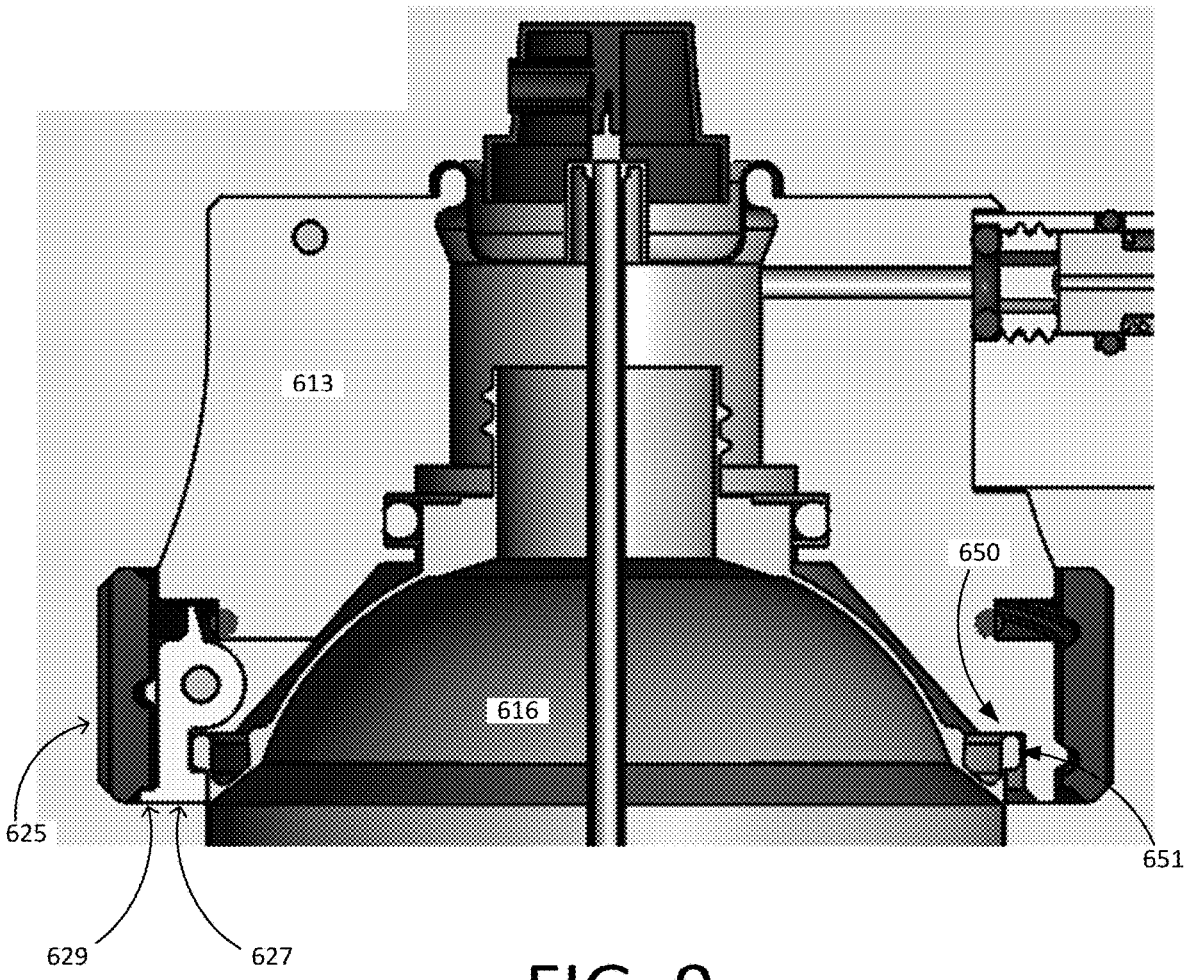

The sprayer-head assembly can include a lid 613 with an internal cavity 622 for receiving the fluid container 616. In examples, the lid 613 can include a side wall 624 that defines a width of an insertion opening 621 through which the container 616 can pass when being inserted into the cavity 622. In examples, a size of the opening 621 can be adjusted between a larger size and a smaller size. For example, the opening 621 can be adjusted to a larger size when the container 616 is inserted, and the opening can be adjusted to a smaller size when the container 616 is positioned within the cavity 622, to allow the side wall 624 (or parts associated with the side wall 624) to clamp onto the container 616. In some examples, the side wall 624 can include an external retaining ring 625 that can rotate relative to (e.g., circumferentially around) the side wall 624. For example, the retaining ring can be rotated to a higher position to increase the opening 621 and can be rotated to a lower position to decrease the opening. In some examples, the opening 621, the side wall 624, and the retaining ring 625 can be operationally associated with gripping latches 627 (e.g., inwardly projecting protrusions or teeth) that are moved out of the way of the opening 621 when the retaining ring 625 is rotated to an up position (e.g., so as not to obstruct the opening), and that can clamp onto the container 616 when the retaining ring is rotated to a lower position. As shown in FIGS. 8 and 9, the latches 627 can pivot around an axis to move between a more open configuration (e.g., FIG. 8), and a clamped configuration (e.g., FIG. 9). In the sprayer assembly 610, the latches 627 can mate with the container 616, and in some examples, the latches 627 can engage a canister for holding a container of fluid (e.g., a coupling mechanism that projects inwardly towards the cavity and is configured to selectively engage the container of fluid, the canister for holding the container of fluid, or any combination thereof.)

In some example, the lid 613 can include an internal shoulder 650 that abuts the top rim 651 when the container 616 is fully inserted. In addition, the lid 613 can include a sealing O-ring 642 that creates an airtight seal with the side of the container's cap 623. Once the container rim 651 has been fully seated against the device shoulder 650, the retaining ring 625 can be spun clockwise down its threads to lock the container 616 in place. In addition, the movement of the retaining ring 625 pushes the latches 627 inward and under the can's top rim. In some examples, catch points 629 on the back of the teeth interfere with the ring 625 when it is at its lowest point to indicate that the device is securely installed. The sprayer-head assembly can be easily transferred or reconfigured to work with many standard industrial fluid containers without concern or working around threading, nozzles, or popped tops. In examples, the latches 627 are spring loading to remain in the open position when not closed by the ring 625. In addition, the design of the latches 627 can create a negligible moment on the rim when under force. In some instances, based on this feature, if the container is under high pressure and the ring is opened, then teeth will remain attached until the internal pressure is reduced to a safe level.

The sprayer assembly 610 can include various other parts, similar to the sprayer assembly 10, such as a quick release air fitting 618 in the handle 615 that can be connected to air hoses to allow the container 616 and its contents to be pressurized. A bored air channel 655 in the handle 615, stem 617, and lid 613 can carry the pressurized air into the container 616. A check valve 660 can be positioned in the stem 617, as well as an internal pressure regulator 658 that controls the allowable pressure level of the contents to ensure that the device operates the same even with a variety of input pressures. In at least some examples, an aerosol valve assembly 662 is crimped onto the top of the lid 613 and includes a fluid intake tube of the appropriate length to reach to the bottom of the respective container. In examples, the sprayer assembly 610 can be used with off-the-shelf, pre-filled, non-pressurized fluid containers. As such, a user doesn't need to handle or pour any fluids which reduces potential hazards from contact and spills. The lack of propellants in the packaging also allows the fluid to sit on shelves longer and transport better. In addition, the air coupling, integrated check valve, and regulator can allow the device to spray product both while connected to a pressurized air hose or disconnected using the built-up internal air pressure. The regulator can be adjusted to vary the output performance of the fluid in relation to the type of actuator used.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A sprayer assembly comprising:

a canister comprising an upper rim and a first connector, the canister comprising a volume configured to receive a container of fluid; and a sprayer-head assembly comprising:

a lid comprising an internal cavity configured to receive the upper rim and a second connector that mates with the first connector to couple the canister to the sprayer-head assembly;

a fluid channel in fluid communication with the internal cavity and with the volume when the canister is coupled to the sprayer-head assembly;

an air-hose fitting coupled to the channel and configured to attach to a pressurize air source;

a nozzle assembly comprising a fluid uptake tube extending into the volume, a nozzle valve, and nozzle head configured to, when depressed, open the nozzle valve and disperse fluid drawn through the fluid update tube; and a trigger engaging the nozzle head, such that the trigger, when actuated, operates the nozzle assembly, the trigger rotatably attached to the lid at a connection and wherein a portion of the trigger comprises a can opener located adjacent the connection and configured to open the container of fluid.

2. The sprayer assembly of claim 1, wherein:

the first connector comprises a channel and the second connector comprises a protuberance projecting into the cavity;

the channel comprises a mouth to receive the protuberance, one or more channel recesses to seat the protuberance, and one or more ramp interfaces to guide the protuberance into the one or more channel recesses when the canister is rotated relative to the sprayer-head assembly with the protuberance in the channel.

3. The sprayer assembly of claim 1, wherein the lid comprises an annular seal that engages the upper rim when the first connector is mated with the second connector.

4. The sprayer assembly of claim 3, wherein the lid comprises an annularly extending shoulder that is configured to be positioned adjacent an upper rim of the container of fluid, when the container of fluid is positioned in the volume and the first connector is mated with the second connector.

5. The sprayer assembly of claim 4, wherein the annularly extending shoulder comprises a notch that provides fluid communication between the cavity and the volume when the container of fluid is positioned in the volume and the first connector is mated with the second connector.

6. The sprayer assembly of claim 4, wherein a base of the canister includes a surface that projects into the volume and that is configured to bias the container of fluid towards the annularly extending shoulder.

7. The sprayer assembly of claim 1 further comprising, a pressure regulator affixed in the fluid channel between the fitting and the cavity.

8. The sprayer assembly of claim 7 further comprising, a check valve affixed in the fluid channel between the pressure regulator and the cavity.

9. The sprayer assembly of claim 1, wherein:

the lid comprises an annular shelf that supports an annular flange of the nozzle assembly; and the lid comprises a removable cover that includes an opening for receiving the nozzle head and that removably attaches to the annular shelf to retain the annular flange between the removable cover and the annular shelf.

10. The sprayer assembly of claim 1 further comprising, a pressure relief valve in fluid communication with the cavity.

* * * * *